US006746546B2

(12) United States Patent
Easterday et al.

(10) Patent No.: US 6,746,546 B2
(45) Date of Patent: Jun. 8, 2004

(54) LOW TEMPERATURE NITRIDING SALT AND METHOD OF USE

(75) Inventors: James R. Easterday, Bloomfield Hills, MI (US); John F. Pilznienski, Dearborn Heights, MI (US)

(73) Assignee: Kolene Corporation, Detroit, MI (US)

( * ) Notice: Subject to any disclaimer, the term of this patent is extended or adjusted under 35 U.S.C. 154(b) by 135 days.

(21) Appl. No.: 10/002,282

(22) Filed: Nov. 2, 2001

(65) Prior Publication Data

US 2003/0084963 A1 May 8, 2003

(51) Int. Cl.[7] ..... C23C 8/26

(52) U.S. Cl. ..... 148/228; 148/229; 148/240; 148/242; 148/274

(58) Field of Search ..... 148/228, 229, 148/240, 242, 274; 252/390

(56) References Cited

U.S. PATENT DOCUMENTS

| | | | | |
|---|---|---|---|---|
| 3,303,063 A | | 2/1967 | Pietryka | 148/15.5 |
| 3,321,338 A | * | 5/1967 | Caubet et al. | 148/217 |
| 3,912,547 A | | 10/1975 | Gaucher et al. | 148/6.11 |
| 4,019,928 A | | 4/1977 | Beyer et al. | 148/15.5 |
| 4,184,899 A | * | 1/1980 | Blas et al. | 148/228 |
| 4,292,094 A | | 9/1981 | Kunst et al. | 148/217 |
| 4,492,604 A | | 1/1985 | Muller et al. | 148/228 |
| 4,717,429 A | | 1/1988 | Kunst et al. | 148/28 |
| 5,518,605 A | | 5/1996 | Hadj-Rabah et al. | 205/148 |

FOREIGN PATENT DOCUMENTS

| | | | |
|---|---|---|---|
| EP | 1055739 A2 | 5/2000 | C21D/9/50 |
| GB | 1105031 | 3/1965 | C23C/9/14 |

OTHER PUBLICATIONS

"Plasma Nitriding of Stainless Steels at Low Temperatures", B. Larisch et al, Technical University Freiberg, pp. 221–228.

"The Response of Austenitic Stainless Steels to Low–temperature Plasma Nitriding", Y. Sun et al, Heat Treatment of Metals, 1999, pp. 9–16.

"Influence of the Steel Composition and Treating Parameters on the Properties of Nitrocarburized Components", G. Wah 1989.

* cited by examiner

*Primary Examiner*—Andrew L. Oltmans
(74) *Attorney, Agent, or Firm*—William N. Hogg

(57) ABSTRACT

A composition for nitrocarburizing stainless steel parts and a method for producing a nitride or hard case on such parts using the composition, are provided. The composition includes alkali metal cyanate and alkali metal carbonate, wherein the cyanate ion is present in a weight percentage of greater than 45% and less than 55.2%. The composition is fused and maintained between about 750° F. and about 950° F. depending upon the type of stainless steel to be treated. The workpiece is immersed in the fused bath and left in until a satisfactory compound layer or case is formed. With austenitic stainless steel, the piece is immersed from about four hours to about six hours at temperatures between about 750° F. and about 950° F., preferably between 750° F. and 850° F. to maintain corrosion resistance.

With 400 series stainless steel, increased corrosion resistance is achieved by immersion for between four and six hours at 950° F.

2 Claims, 5 Drawing Sheets

304 STAINLESS STEEL

4/6 Stainless Steel

DIFFUSION 416 STAINLESS STEEL

LOW TEMPERATURE NITRIDING SALT AND METHOD OF USE

FIELD OF THE INVENTION

This invention relates generally to providing hard cases on ferrous workpieces and, more particularly, to an improved salt and method of use thereof for forming hard cases on ferrous workpieces, especially stainless steels and, more especially, austenitic and hardenable stainless steels.

BACKGROUND INFORMATION

It is known that ferritic nitrocarburizing at typical processing temperatures in various media, such as salt bath nitrocarburizing (also called salt bath nitriding) at about 1075° F., enhances the corrosion resistance of carbon steels and low alloy steels, particularly if a post nitrocarburizing treatment, such as a quench-polish-quench, is employed. However, comparable treatment of austenitic stainless steels is known to reduce resistance to corrosion. Also, it is known that significant improvement in corrosion resistance over the as-processed corrosion resistance for nitrocarburized 420 grade and other hardenable stainless steel can be achieved by increasing the depth of the case hardened or compound layer on the surface thereof.

However, with the same treatment of austenitic stainless steels at 1075° F. to increase the compound layer, a degradation of the corrosion resistance results. In fact, increasing the temperature of the salt bath to about 1166° F. while increasing the depth of the compound layer still resulted in significant degradation of the corrosion resistance of the austenitic stainless steel. Thus, if one were to utilize conventional salt bath nitriding at conventional temperatures of 1075° F. to achieve a compound layer of increased hardness to thereby increase wear resistance, one would be confronted with a resultant significant loss of corrosion resistance which is associated with and normally expected from austenitic grades of stainless steel.

Moreover, even though a significant depth of the compound layer formed on the surface of hardenable stainless steel, such as the 400 series, results in increased corrosion resistance, if this is achieved at a temperature above the tempering temperature, a reduction in core hardness will result; and 1075° F., a conventional salt bath nitriding temperature, is above the desired tempering temperature of some products.

SUMMARY OF THE INVENTION

According to the present invention, a composition for nitrocarburizing stainless steel parts and a method for producing a nitride or hard case on such parts using the composition, sometimes referred to as salt bath nitriding, are provided. The composition includes alkali metal cyanate and alkali metal carbonate, wherein the cyanate ion (CNO—) is present in a weight percentage of greater than 45% and less than 53%. The composition is fused and maintained at a temperature of between about 750° F. and about 950° F. depending upon the type of stainless steel to be treated. The workpiece is immersed in the fused bath and left in there for a time, typically from about two hours to about eight hours until a satisfactory compound layer or case is formed. The best results are achieved with austenitic stainless steel wherein the piece is immersed from about three hours to about eight hours at temperatures between about 750° F. and about 850° F. With temperatures above 850° F. to 950° F., corrosion resistance is significantly reduced.

With respect to the hardenable 400 series stainless steel, increased corrosion resistance can be achieved by immersion for between four and six hours at 950° F.

DESCRIPTION OF THE PREFERRED EMBODIMENT

Figure 1:
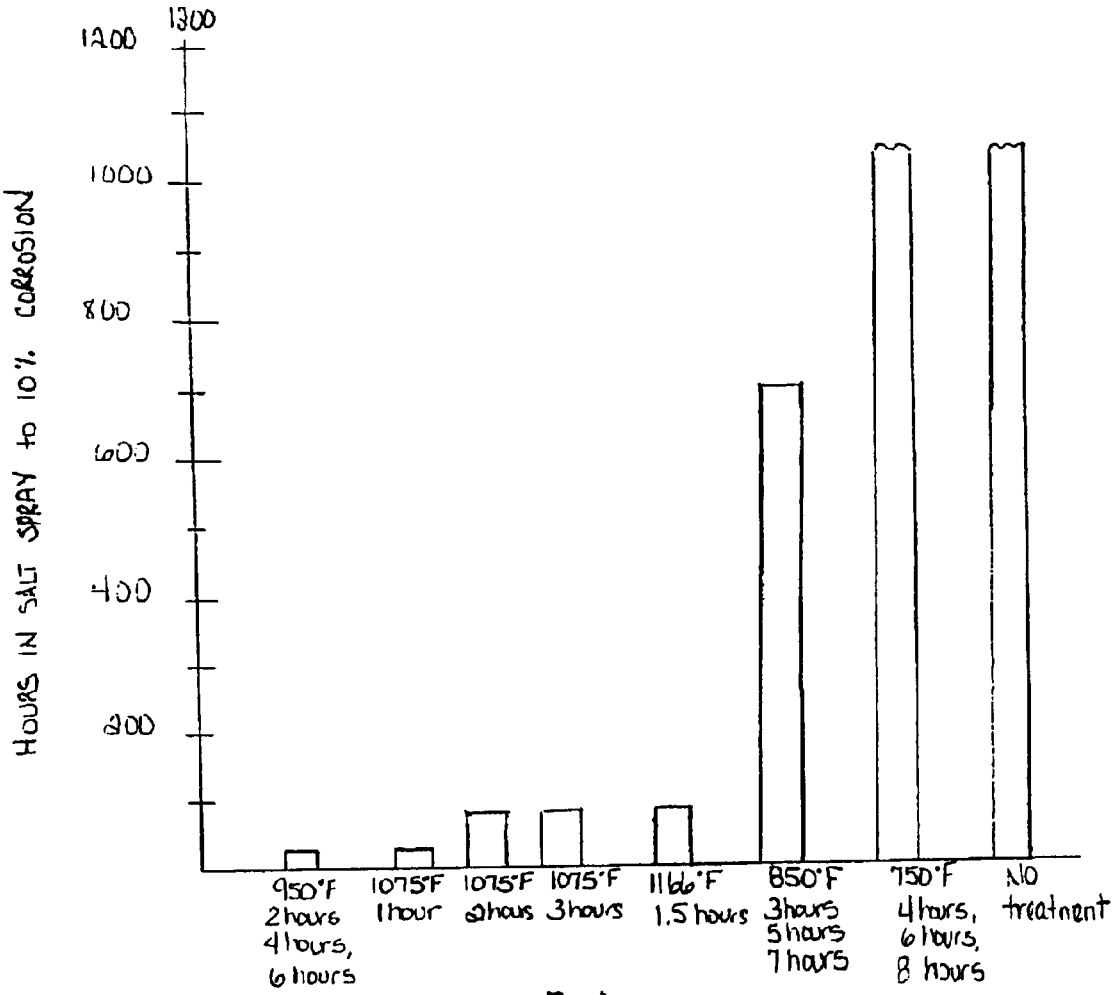
FIG. 1 is a bar graph of the corrosion resistance of various samples of 304 stainless steel treated at various temperatures.

In essence, the present invention provides an improved salt composition for salt bath nitriding stainless steel parts at reduced temperatures and a method of using the salt to provide improved results on stainless steel parts. As used herein, the term "nitriding" refers to forming a surface layer or compound layer (CL). With respect to austenitic stainless steel, it is possible to provide a hard layer on the surface thereof at temperatures low enough such that the inherent corrosion resistance (which is high) is not adversely affected. As indicated earlier, prior attempts at nitrocarburizing austenitic stainless steels at conventional temperatures, e.g. 1075° F. and above, in conventional salt baths has resulted in a substantial and significant reduction in corrosion resistance, thus forcing the designer of the part or the structure using a nitrocarburized surface to sacrifice corrosion resistance for case hardening, or sacrifice case hardness for corrosion resistance.

With respect to hardenable grades of stainless steels, such as the 400 series stainless steel, corrosion resistance in the hardened and tempered condition can be increased and a compound layer formed on the surface at a temperature low enough to prevent degradation of the core hardness in certain conventional hardened and tempered conditions of the stainless steel part. Thus, a benefit is derived in using the present invention in treating austenitic grade stainless steels in that a hardened case can be provided without sacrificing the corrosion resistance and, in the case of hardenable stainless steel, it is possible to maintain the corrosion resistance obtained at normal nitrocarburizing temperatures while not adversely affecting the core hardness in the hardened and tempered condition. (As used herein, the term "hardenable", or "hardened stainless steel" refers to transformation hardening by the formation of martensite, not precipitation hardening by the precipitation of carbides.)

The salt bath composition for the improved nitrocarburizing bath, which is useful at temperatures between about 750° F. and about 950° F., comprises an alkali metal cyanate and an alkali metal carbonate, wherein the cyanate ion is present in a weight percentage of greater than 45% and less than 53%, preferably between 48% and 50%, and more preferably at about 48%. The alkali metal cyanate and alkali metal carbonate are preferably either sodium cyanate or potassium cyanate or mixtures of sodium and potassium cyanate, preferably mixtures of sodium and potassium cyanate wherein the ratio of the potassium to the sodium is about 3.9 to 1. The bath is used in a fused condition, as indicated above, between about 750° F. and about 950° F. It has been found that the higher the cyanate content, the lower the melting temperature of the salt, such that the cyanate content in the range of greater than 45% allows the bath to be molten and eventually homogeneous at temperatures between 750° F. and 950° F. With the cyanate content at 45% or below, it is difficult to maintain a homogeneous molten salt, especially in the lower part of the range of 750° F. to 950° F. The workpieces are immersed in the fused bath and a nitride or a hard microstructural phase (sometimes referred to as a "compound layer") is formed. As workpieces are nitrocarburized in the bath, the cyanate composition, which is depleted during the nitrocarburizing process, is maintained by adding a regenerator to the bath. Preferably, the regenerator is either melamine or urea or a derivative of melamine, such as melam, melem and melom. The regenerator reacts with the carbonate to replenish the cyanate ion which is depleted in the nitrocarburizing reaction. Thus, it is important to have some carbonate ion present for the reaction to take place. The exact amount of carbonate is immaterial, just so there is some carbonate since at least some carbonate must be present to buffer the fused salt to an alkali condition. If the carbonate is completely depleted by reaction with the regenerator, this can have an adverse effect in that the bath has a propensity to attack the pot material containing the bath, and also in the formation of unwanted and ineffective regenerator material. Thus, it is necessary in the fused condition that the bath contains at least a measurable amount of carbonate. There is no maximum amount of carbonate that needs to be present, provided, however, that the amount is within the soluble range of carbonate.

In an alkali metal cyanate mixture, with a potassium to sodium ratio of about 3.9 to 1 by weight, what appears to be a eutectic composition forms. Thus, the lowest melting point of the salt mixture is achieved at this composition. With pure potassium cyanate or pure sodium cyanate, or with different ratios of potassium cyanate to sodium cyanate, the melting point rises. Thus, in the optimum composition, additionally there must be a sufficiently low cyanate content to allow the formation of at least a measurable amount of alkali metal carbonate. It has been found that, as the temperature is lowered below 1075° F., the amount of carbonate that can be retained in solution in the bath decreases, thus the amount of CNO— necessitating excess carbonate present in a conventional bath, or starting with a lower initial percent of carbonate, a lower melting point of the salt can be achieved. The theoretical maximum of CNO— is about 55.2 weight percent, at which percentage there is no carbonate. The melting temperature of this composition is below 750° F. However, a fluid bath at 750° F with significant carbonate can be achieved with 48% CNO— and, since lower nitrocarburizing temperatures have not been shown to be useful with stainless steel, 48% CNO— is the preferred weight percentage of CNO—. The optimum amount of cyanate ion with the ratio of potassium to sodium at 3.9 to 1 by weight is about 48%.

When the baths are in use, a small amount of CN (cyanide ion) in the range of 1% to 4% may be formed from the cyanate. This is not added as a component to the bath. However, when the bath is not in use, and the bath is aerated, this cyanide is converted, at least in part, to cyanate.

In use, the composition is fused and then maintained at the desired temperature, the selection of which will be discussed presently, and the workpiece to be nitrocarburized is immersed in the fused bath for the desired period, the selection of which period also will be discussed later. Following the nitrocarburizing treatment in the fused bath, conventional post treatments can be performed if desired, some of which will increase corrosion resistance. For example, the post nitrocarburizing treatment, which is known as a quench-polish-quench operation, can be performed. This involves quenching the workpiece as it comes out of the nitrocarburizing bath at 750° F.–1166° F. in an oxidizing bath at 750° F. for a period of 20 minutes followed by a mechanical polish, followed by a second quench in the same bath at the same temperature for a time of 20 minutes.

Tests were performed on various samples of different types of steel to determine the effectiveness of salt bath nitriding at various temperatures using the composition of the present invention at temperatures from 750° F. to 950° F. and also at various times using a conventional prior art salt bath composition, at temperatures from 1000° F. to 1166° F. The test specimens were cylindrical rods, about one-half inch in diameter and about five inches long, with a small cross hole at one end to permit handling.

For temperatures between 750° F. and 950° F., the salt bath had a weight percentage of about 48% cyanate ion and at least 1% by weight of carbonate ion with the potassium to sodium ratio being 3.9 to 1.0. (Post treatments referred to as quench-polish-quench, as described above, were performed in some cases.) All salt bath nitriding performed at temperatures from 1000° F. to 1166° F. were performed in a fused salt bath having about 38% by weight of cyanate ions and at least 1% by weight of carbonate ions, again with the ratio of potassium to sodium being about 3.9 to 1.0.

In performing the test, the test specimens were immersed in the fused bath at various temperatures for various times and then various properties of the test specimens were measured, such as case hardness, case depth and, in the case of hardenable stainless steel, core strength of the specimen. Specifically, tests were performed on 304 grade stainless steel and 316 grade stainless steel and also on 416 grade stainless steel.

With respect to the 304 stainless steel, specimens were salt bath nitrided in the as-processed annealed condition. Five different salt bath nitriding temperatures were used, with the corresponding time cycles selected to provide various "compound layer" (CL) depths. This "compound layer" is sometimes referred to as the case. Two specimens or samples were treated according to each of the conditions of temperature and time indicated in Table I below. The composition of the salt bath for those specimens treated at 750° F. to 950° F. was a salt bath according to the present invention, including an alkali metal cyanate with 48% cyanate ion and at least 1% carbonate ion with the potassium to sodium ratio being 3.9 to 1.0. Those specimens that were treated in conventional salts for salt bath nitriding had about 35% cyanate ion, with the potassium sodium ratio being 3.9 to 1.0 and at least about 1% carbonate.

TABLE I

| Temperature | Salt Bath Nitriding Time, Hours | | |
|---|---|---|---|
| No Salt Bath Nitriding | | | |
| 750° F. | 4 | 6 | 8 |
| 850° F. | 3 | 5 | 7 |
| 950° F. | 2 | 4 | 6 |
| 1075° F. | 1 | 2 | 3 |
| 1166° F. | 1.5 | | |

Specifically, the object of the tests with respect to the 304 stainless steel, which is characteristic of the austenitic grade, was to determine the effect of salt bath nitriding at various temperatures and times on the corrosion resistance of the material and the depth of CL or hard layer formed.

The test results of the salt bath nitriding performed on 304 stainless steel according to the parameters set forth therein are shown in Table I. The corrosion resistance of the 304 stainless steel is as shown graphically in FIG. 1 with bar graphs. The corrosion test was performed in accordance with ASTM B-117-90 specifications, using a Singleton Chamber Model PSF22. The end point for each corrosion test was based on salt exposure time required to produce a corroded surface area of 10% on each sample. The test was terminated after 10% area was corroded or 1032 hours, whichever came first. Where multiple samples were used, the bar graph shows the maximum time.

The most notable result was that, at a temperature of 750° F., the sample of 304 stainless steel displayed corrosion resistant protection equal to a non or untreated surface, showing no evidence of corrosion after 1032 hours exposure to salt spray. Increasing the salt bath temperature to 850° F. resulted in a decided decrease in corrosion resistance, dropping to approximately 600 hours exposure. With additional increase in temperature, i.e. to 950° F. and above, corrosion resistance drops below 100 hours.

The reason for the improved corrosion resistance at low temperatures or, rather, the increase in corrosion susceptibility at higher temperatures, is not completely understood. However, as has been noted previously, in the heating of austenitic grade stainless steel, there are two transition temperatures that are dependent on alloy composition of the stainless steel which have been identified in this lower range of temperatures. For the 304 stainless, the first is at T1, which occurs at a temperature of about 815° F. The higher transition temperature, known as T2, occurs at about 905° F. It has been postulated that, below 815° F., a microstructural phase termed as 'S' phase and defined as expanded austenite exists totally, and provides excellent corrosion resistance. As the temperatures increase above 815° F., the 'S' phase begins to transform into nitride(s) and, at 950° F., it is completely transformed into nitrides. The nitride phase has corrosion resistance that is significantly reduced over that of the 'S' phase. It is believed that this may explain the excellent test results of the 304 stainless steel at 750° F. and the somewhat decreased corrosion resistance at 850° F. and the much poorer corrosion resistance at 950° F. Thus, if a sufficient case can be provided at below about 815° F., a hardened surface can be provided without degradation of the corrosion resistance characteristics. Even at temperatures up to 850° F., corrosion resistance is improved over nitrocarburizing at temperatures above 950° F.

Figure 2:
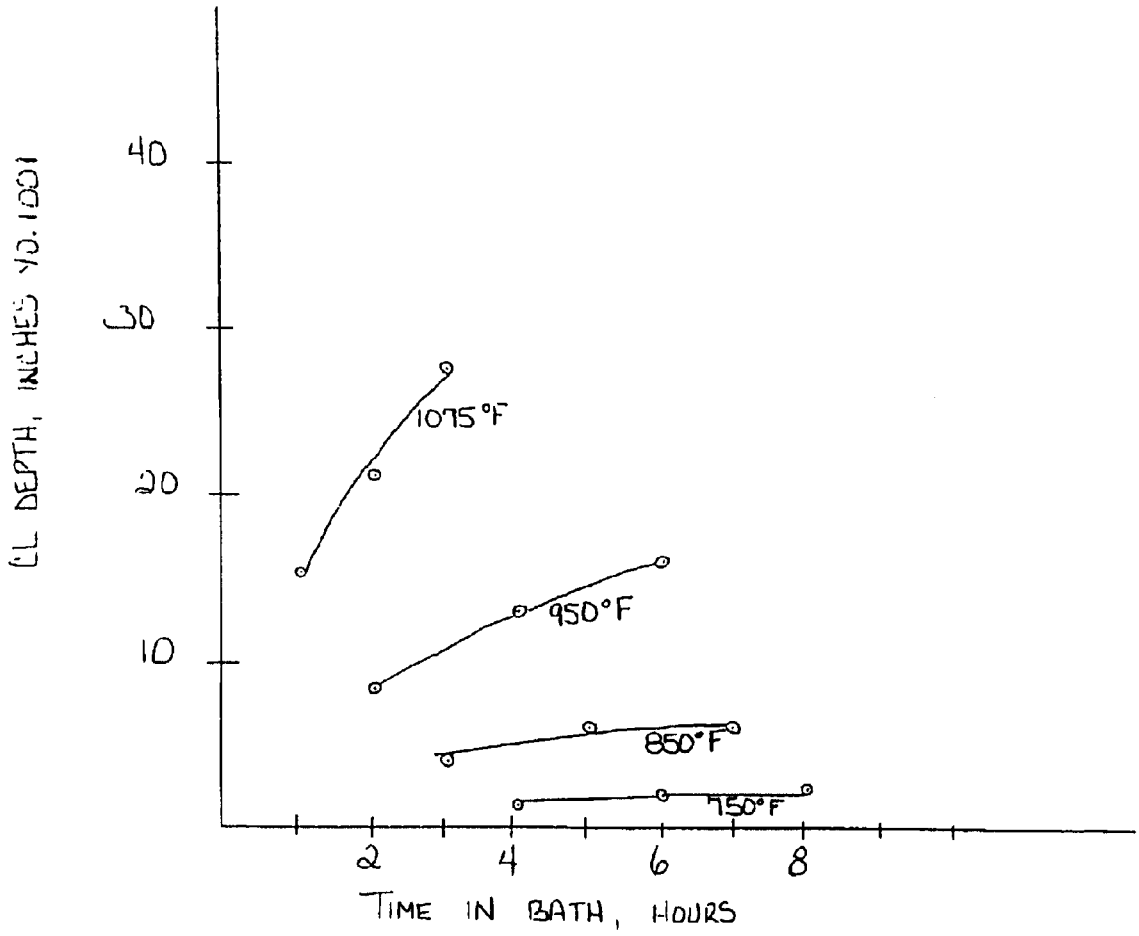
FIG. 2 is a set of curves showing the depth of the outer contact layer or case formed at various temperatures of salt bath nitriding for various times, both with conventional nitrocarburizing salt and the salt of the present invention, on samples of 304 stainless steel.

Diffusion characteristics of the 304 stainless steel resulting in the "compound layer" CL within the 750° F.–1166° F. temperature range were determined by measurement of the "compound layer" CL. This is identified as the total uninterrupted depths of a nondefinable compound(s) or microstructural phase(s) as observed metallographically. The depth of this CL is shown as a function of time and temperature in several curves in FIG. 2. These curves demonstrate the significant influence of temperature on diffusion rates. At 750° F., the effect of time on diffusion rate between four hours and eight hours is minimal, with the resulting compound layer depth not exceeding about 0.0002 in. Also, at approximately the mid-depth within the compound layer of the four hour specimen, a circumferential crack was observed parallel to the surface. Attempts were made to determine the intrinsic hardness of the 'S' phase (as defined above), although the compound layer depths of the 750° F. specimen were too shallow to support a microhardness determination. The surface of the four hour specimen appeared to be file hard. This is a well-known test for hardness wherein a file is applied to the surface of the specimen and, if the surface resists the "biting" action of the file, it is considered to be file hard. It is estimated that this file hard surface was probably about HRC 65 ($R_C$65). A microhardness test was made on the five hour 850° F. specimen and displayed a hardness of $HK_{25}$ 1500. This corresponds to>70 HRC.

Further examination of the 950° F. and 1075° F. test specimens disclosed a dark microstructural phase. Thus, it is believed that the treatment in a low melting temperature nitrocarburizing salt of the present invention between the temperatures of 750° F. and 815° F. will provide a shallow but discernible hardened case without adversely affecting the corrosion resistance. Even temperatures between 815° F. and 850° F. will provide a deeper case while somewhat diminishing the corrosion resistance. This result may be acceptable.

Similar tests were performed on 316 grade stainless steel, which gave results similar to the results of the tests performed on the 304 grade stainless steel, except that there was no decrease of corrosion resistance at temperatures as high as 850° F. It is believed that this is because molybdenum is present in 316 grade stainless steel and has a stabilizing effect on the expanded austenite.

Tests were also performed on test specimens of 416 grade stainless steel which were vacuum hardened at 1800° F., air quenched and then tempered in accordance with the pretreatment indicated in Table II below. The hardened and tempered samples of 416 stainless steel were then treated in salt bath nitriding for the times and temperatures indicated in Table II below. Again, the composition of the salt bath for those specimens treated at 750° F. to 950° F. was a salt bath according to the present invention, including alkaline metal cyanate with 48% cyanate ion and at least 1% carbonate ion with the potassium to sodium ratio being 3.9 to 1.0. Those specimens were treated in conventional salts for salt bath nitriding which had alkali metal cyanate with about 35% cyanate ion, and the potassium to sodium ratio being 3.9 to 1.0 and at least about 1% carbonate ion.

TABLE II

| Pre-treatment | Temperature Salt Bath Nitride | Time, Hours | | |
|---|---|---|---|---|
| Tempered 750° F. | 750° F. | 4 | 6 | 8 |
| | 750° F.* | 4 | | |
| Tempered 1060° F. | No | | | |
| | 850° F. | 3 | 5 | 7 |
| | 850° F.* | 3 | | |
| | 950° F. | 2 | 4 | 6 |

TABLE II-continued

| Pre-treatment | Temperature Salt Bath Nitride | Time, Hours | | |
|---|---|---|---|---|
| | 950° F* | 2 | | |
| | 1075° F. | 1 | 2 | 3 |
| | 1075° F.* | 1 | | |
| | 1166° F. | 1.5 | | |
| | 1166° F.* | 1.5 | | |

*Quench-Polish-Quench

Figure 3:
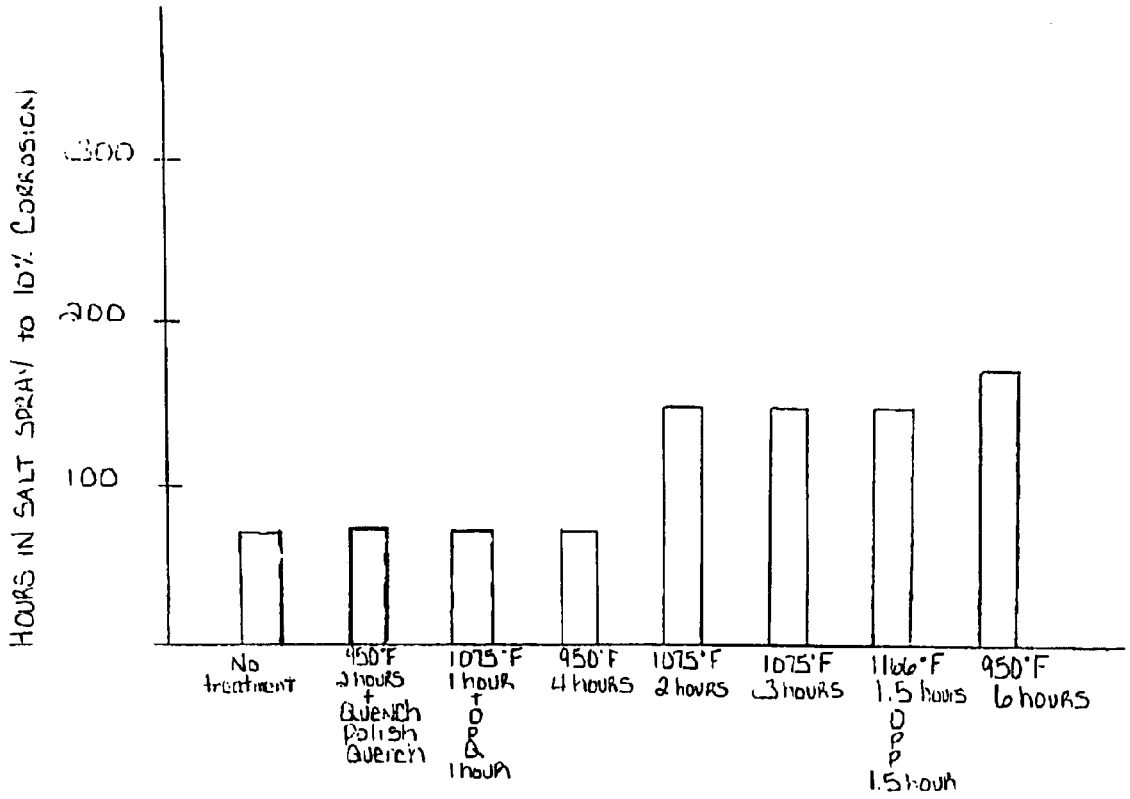
FIG. 3 is a bar graph of corrosion resistance of various samples of 416 stainless steel which have been heat treated and subject to salt bath nitriding at various temperatures for various times, both according to the present invention and according to conventional salt bath nitriding.

Salt spray test results using the same technique as that described with respect to the 5 spray tests for the 304 grade stainless steel are shown in FIG. 3. As can be seen in FIG. 3, if no salt bath nitriding treatment is used, the time to 10% corrosion is significantly less than 100 hours. The same value holds for a salt bath treatment at 950° F. for two hours, 1075° F. for one hour, and 950° F. for four hours. However, an increase in corrosion resistance to about 150 hours will be achieved with salt bath treatment at 1075° F. for two hours, 1075° F. for three hours, 1166° F. for one and one-half hours and, significantly, a salt bath treatment at 950° F. for six hours. Again, when multiple samples were tested, the maximum time is shown. Thus, by treating the part at a temperature of 950° F., which is 125° F. below a normal salt bath treatment of 1075° F., a case can be established which provides at least as good corrosion resistance as at higher temperature nitrocarburizing at shorter times.

Figure 4:
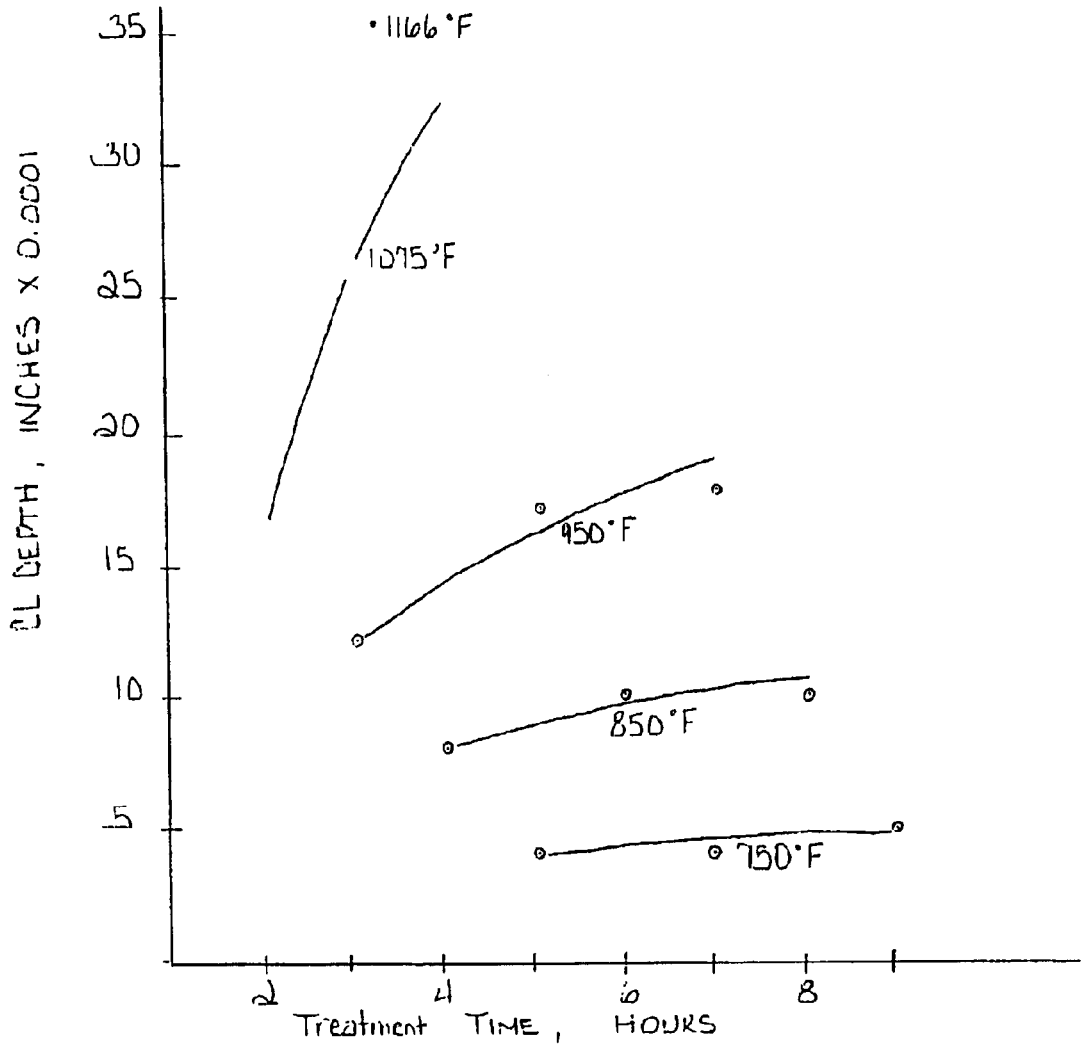
FIG. 4 is a set of curves of depth of the contact layer or case formed using various temperatures and various salt bath nitriding compositions at various times on various samples of 416 stainless steel.

FIG. 4 comprises curves showing the depth of the case formed at various times and temperatures on the specimens of the 416 grade stainless steel.

Figure 5:
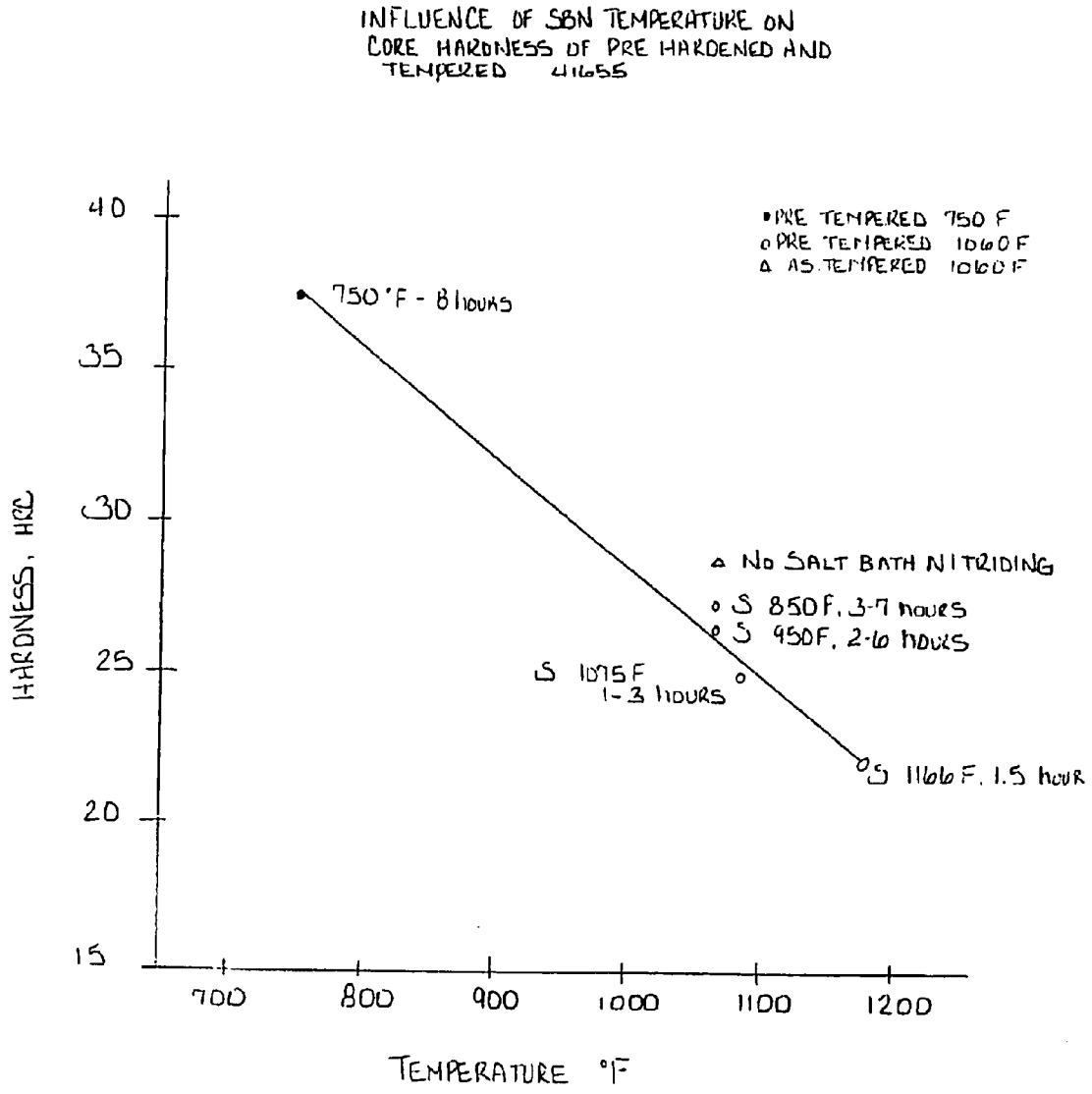
FIG. 5 is a curve showing the core hardness of 416 stainless steel after salt bath nitriding in various salts for various times.
Figure 1:
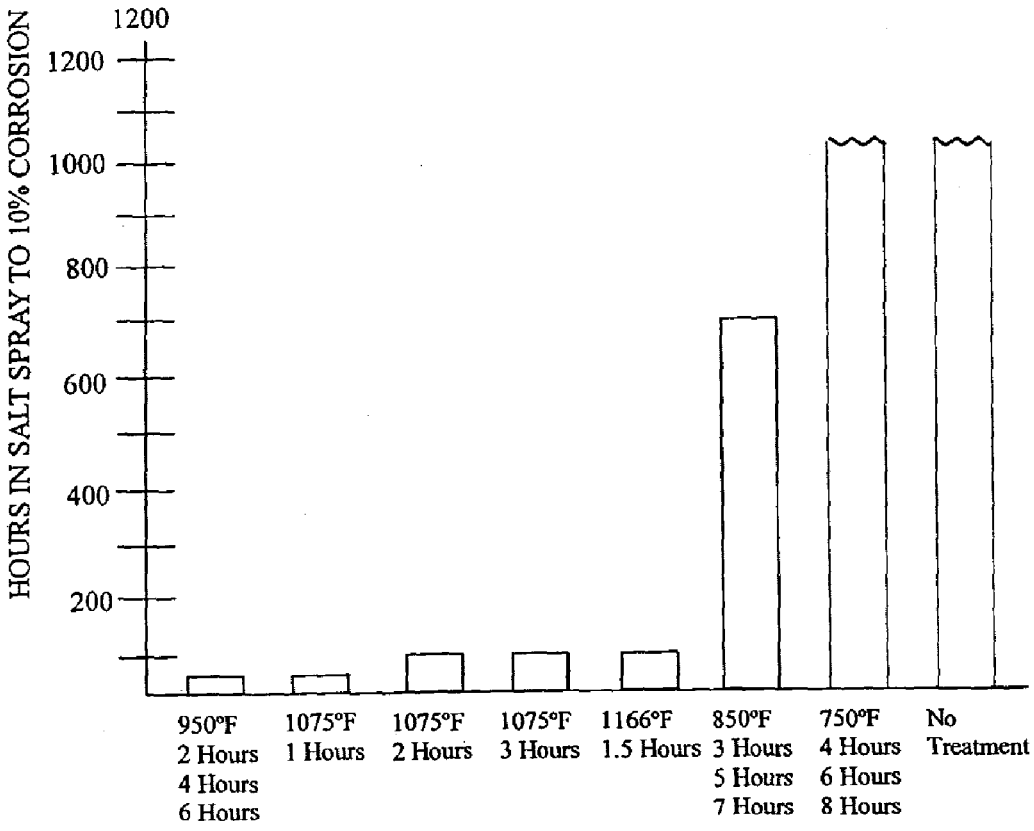
Figure 2:
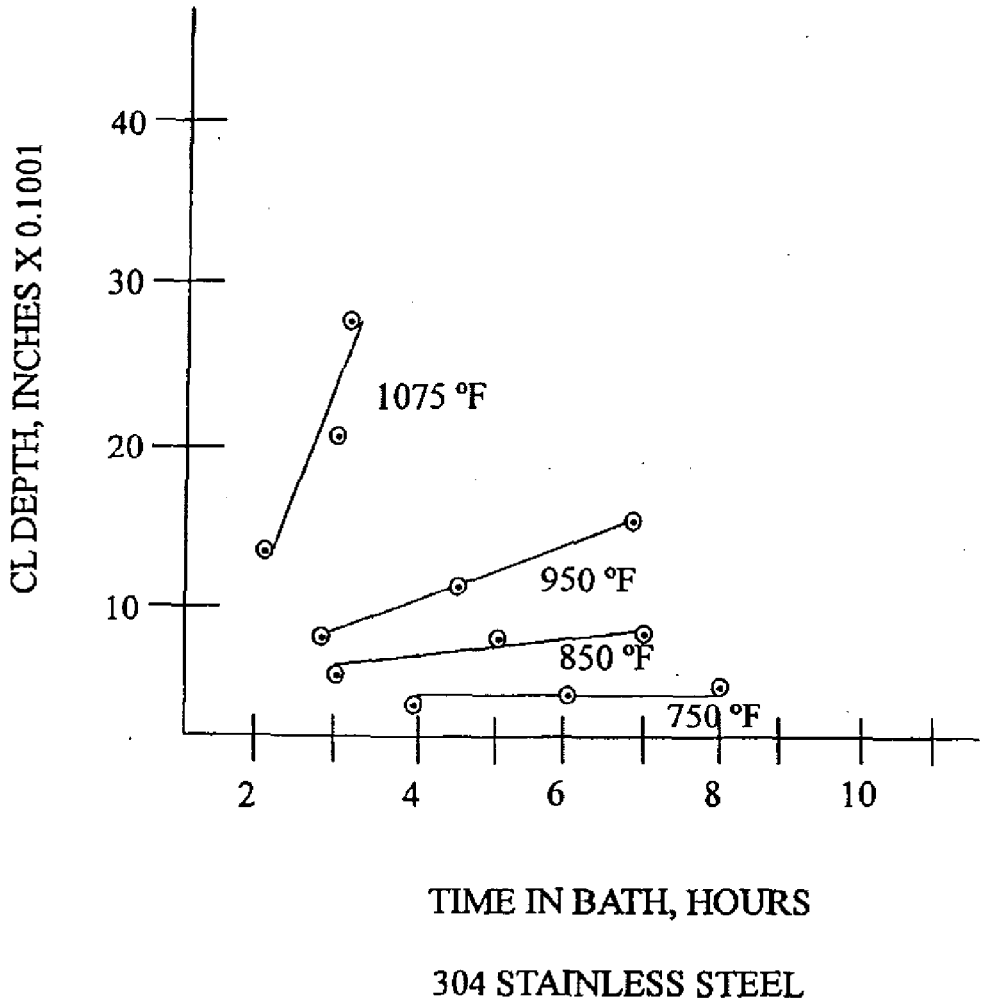
Figure 3:
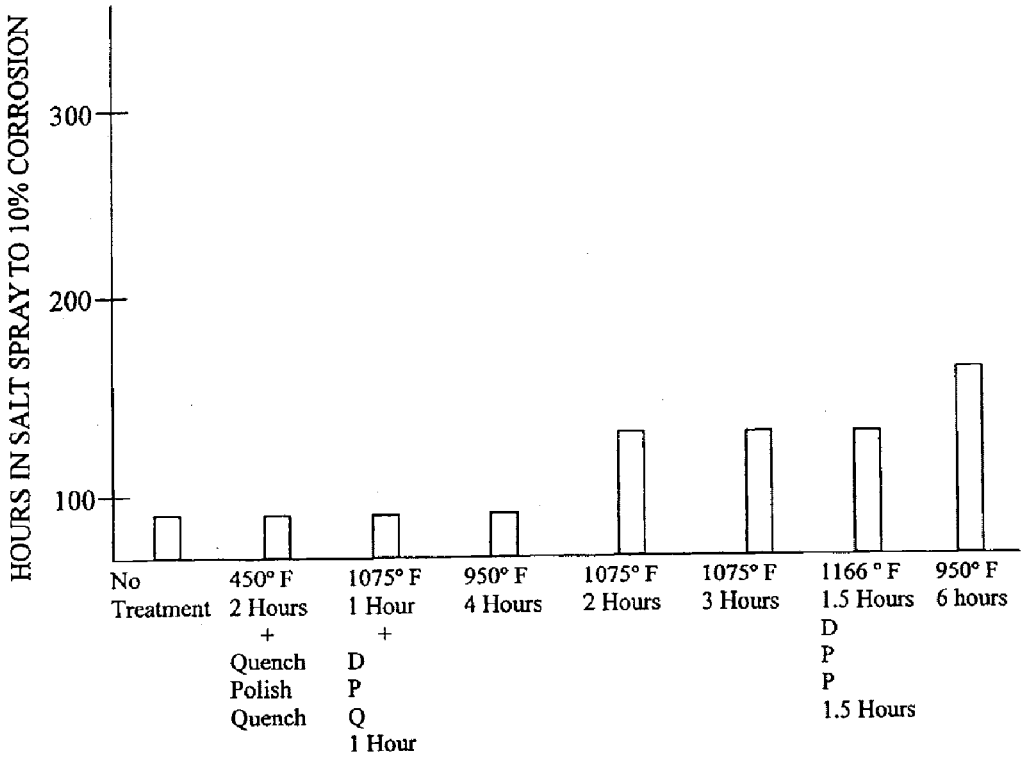
Figure 4:
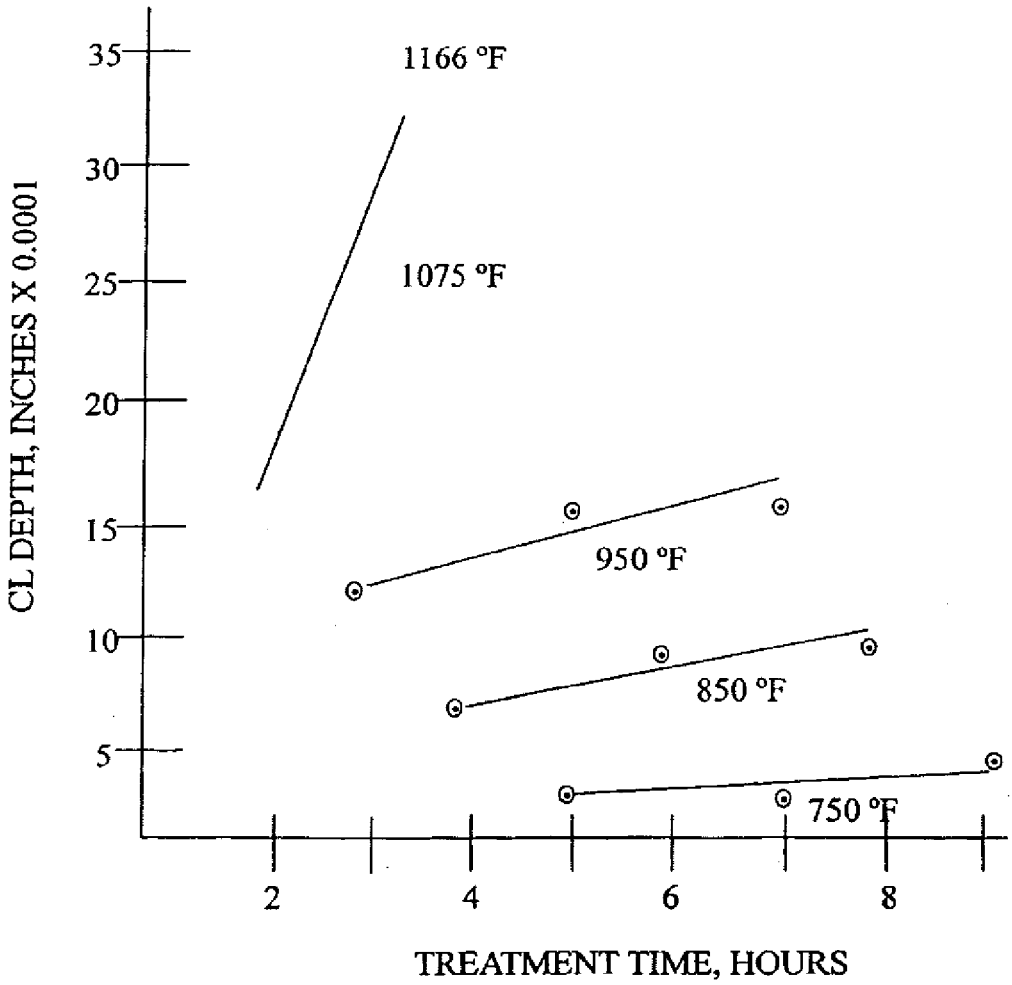
Figure 5:
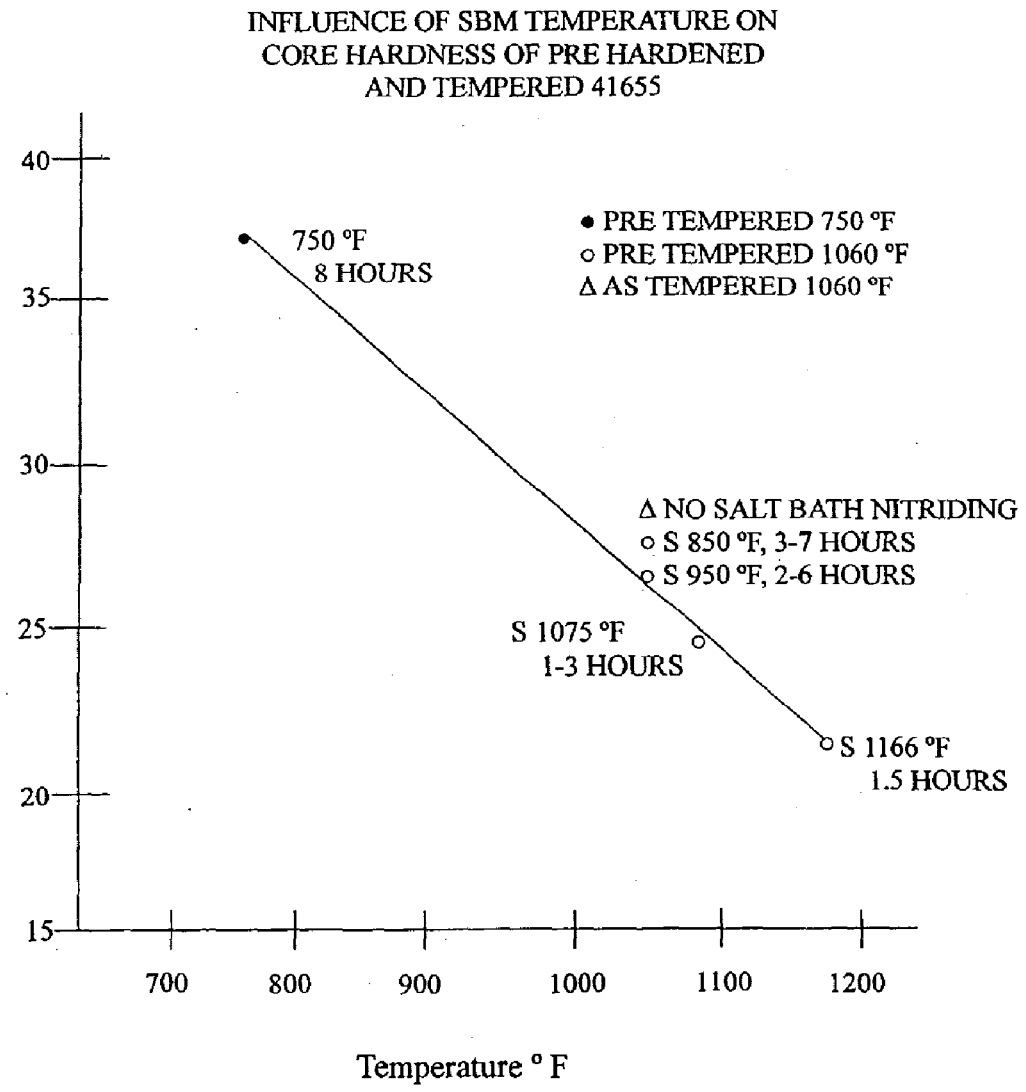
Figure 1:
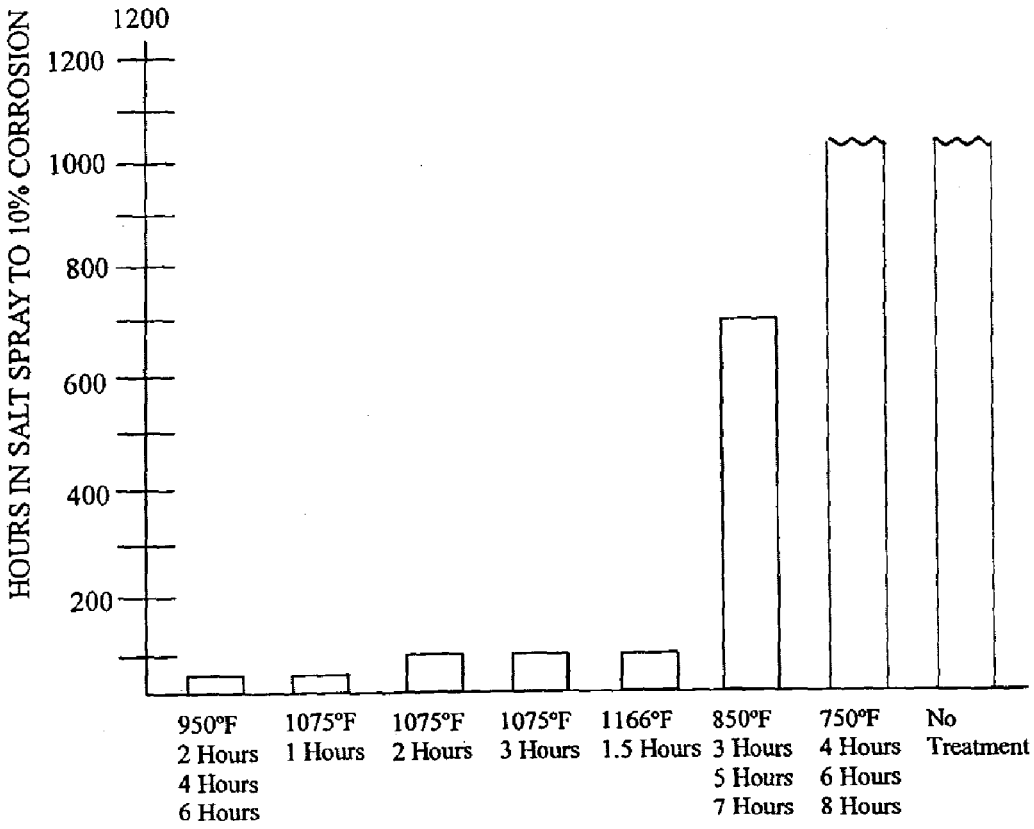
Figure 2:
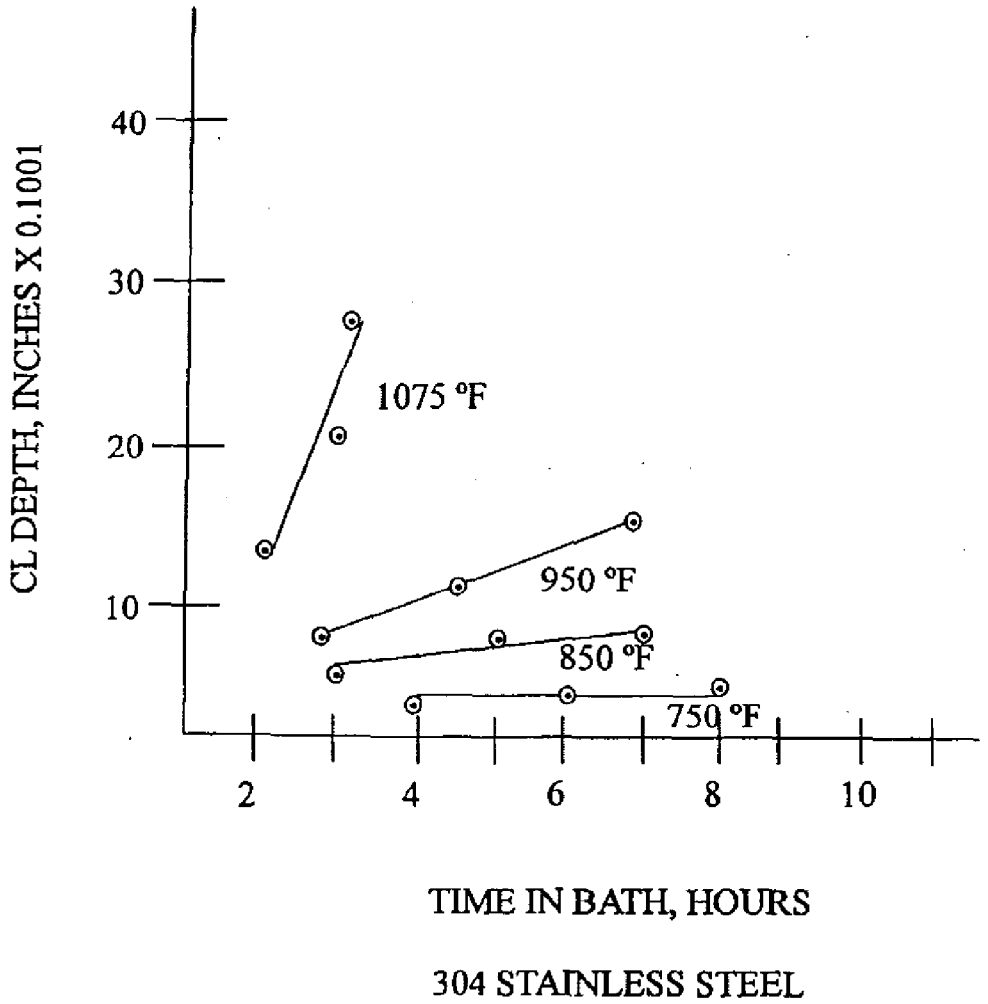
Figure 3:
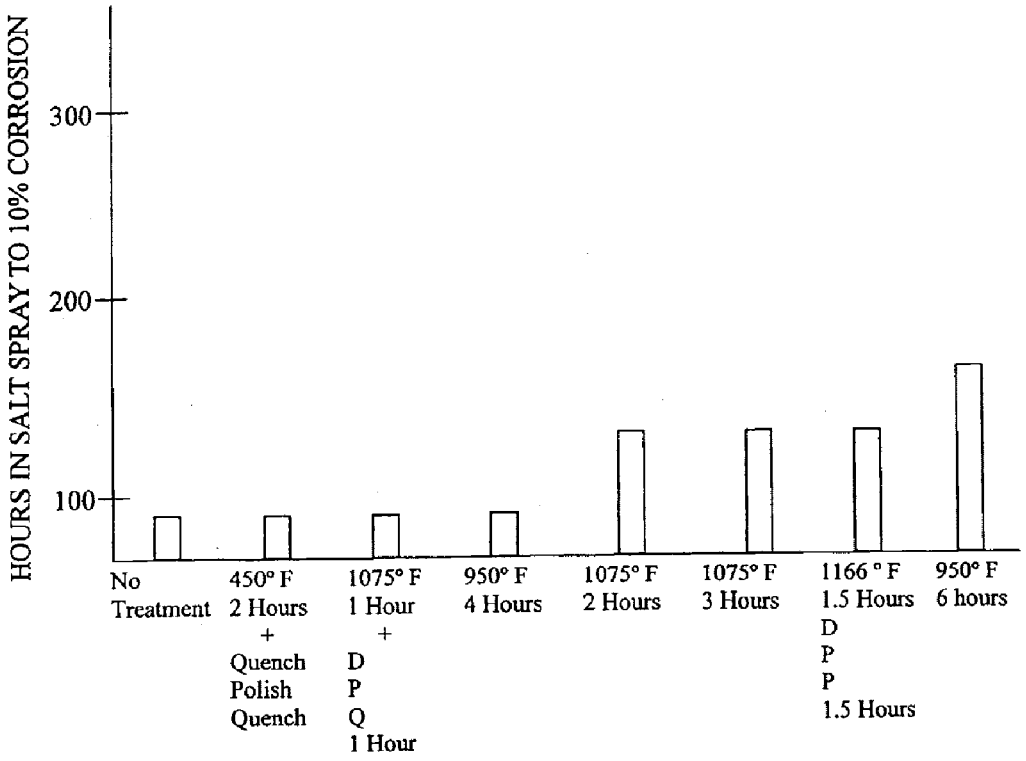
Figure 4:
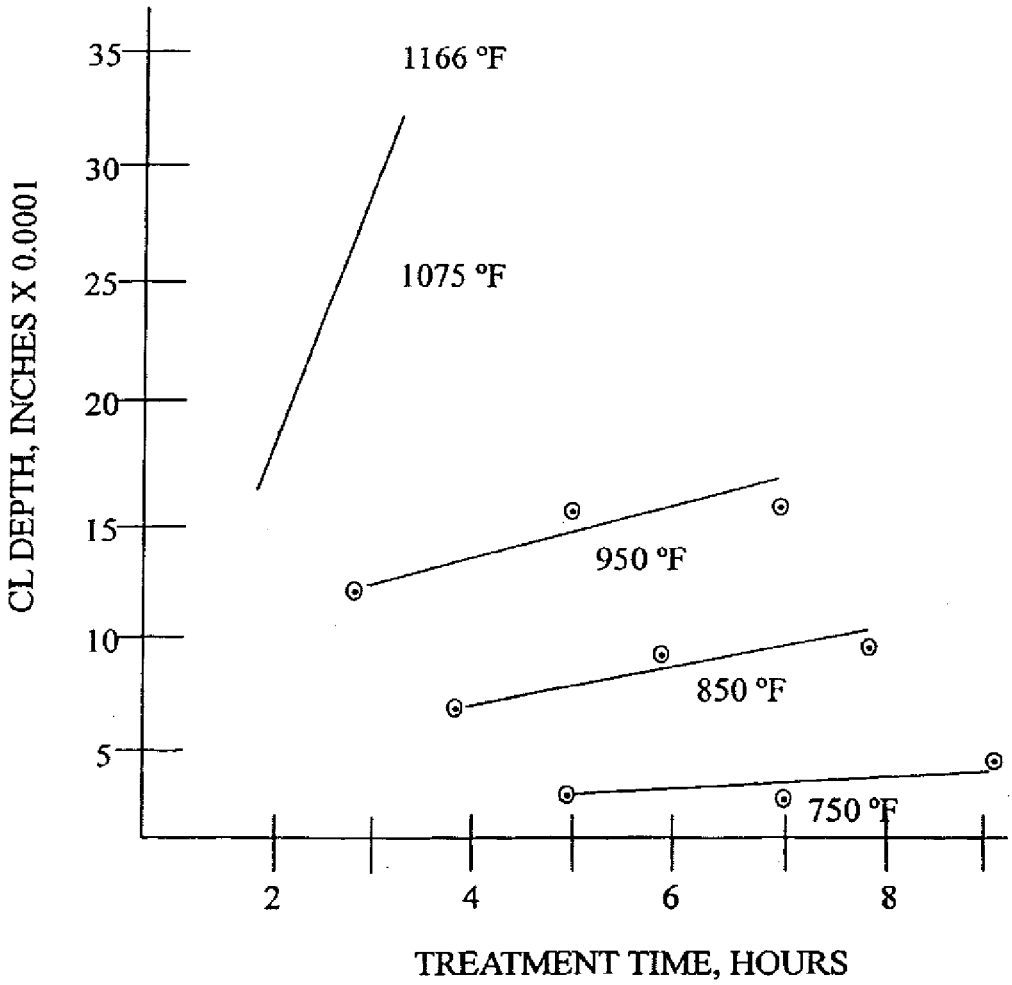
Figure 5:
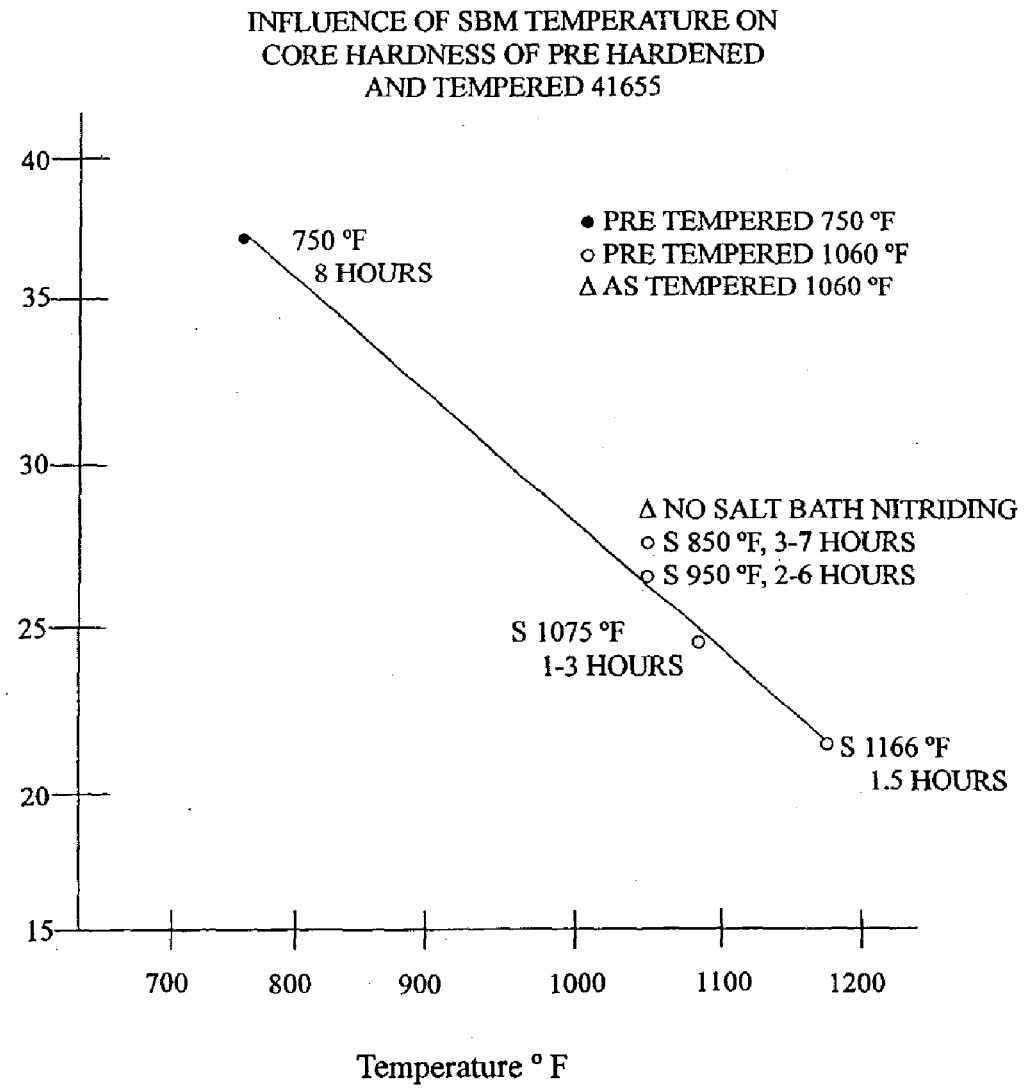

FIG. 5 is a curve that shows the influence of the salt bath nitriding temperature on the core hardness of the pre-hardened and tempered 416 grade stainless steel. As can be seen in FIG. 5, the 750° F. salt bath nitriding at either four, six or eight hours does not affect the core hardness of the specimen that was pre-tempered at 750° F. However, if a piece is pre-tempered at a higher degree or is salt bath nitrided at a higher temperature subsequently, the core hardness is correspondingly reduced as would be expected. Thus, it is possible to provide corrosion resistance in hardenable stainless steel, comparable to that achieved at salt bath nitriding temperature of 1075° F. by salt bath nitriding them at 950° F, albeit for a longer time and, therefore, preserve higher core hardness.

The use of low temperature salt bath nitriding according to this invention does not seem to provide any beneficial effect vis-a-vis precipitation hardened stainless steel, such as 17-4 pH.

Accordingly, the preferred embodiments of the present invention have been described. With the foregoing description in mind, however, it is understood that this description is made only by way of example, that the invention is not limited to the particular embodiments described herein, and that various rearrangements, modifications, and substitutions may be implemented without departing from the true spirit of the invention as hereinafter claimed.

What is claimed is:

1. A method for producing a nitride or a hard case on an austenitic stainless steel workpiece comprising the steps of:

providing a fused bath of alkali metal cyanate and alkali metal carbonate, wherein said cyanate ion is present in a weight percentage of greater than 45% and less than 55.2%, maintained at a temperature of between 750° F. and 850° F., and immersing a workpiece of said austenitic stainless steel in said bath for at least four hours.

2. The invention as defined in claim 1 wherein the temperature is between about 750° F. and 815° F. and the workpiece is 304 stainless steel.

* * * * *

UNITED STATES PATENT AND TRADEMARK OFFICE

CERTIFICATE OF CORRECTION

PATENT NO. : 6,746,546 B2
DATED : June 8, 2004
INVENTOR(S) : Easterday et al.

It is certified that error appears in the above-identified patent and that said Letters Patent is hereby corrected as shown below:

Please replace the specification with the new attached specification including Figure 1.

Please replace Formal Drawings 1-5 with the attached drawings.

Signed and Sealed this

Twenty-third Day of November, 2004

JON W. DUDAS
*Director of the United States Patent and Trademark Office*

(12) United States Patent
Easterday et al.

(10) Patent No.: US 6,746,546 B2
(45) Date of Patent: Jun. 8, 2004

(54) LOW TEMPERATURE NITRIDING SALT AND METHOD OF USE

(75) Inventors: James R. Easterday, Bloomfield Hills, MI (US); John F. Pilznienski, Dearborn Heights, MI (US)

(73) Assignee: Kolene Corporation, Detroit, MI (US)

( * ) Notice: Subject to any disclaimer, the term of this patent is extended or adjusted under 35 U.S.C. 154(b) by 135 days.

(21) Appl. No.: 10/002,282

(22) Filed: Nov. 2, 2001

(65) Prior Publication Data

US 2003/0084963 A1 May 8, 2003

(51) Int. Cl.[7] ..... C23C 8/26

(52) U.S. Cl. ..... 148/228; 148/229; 148/240; 148/242; 148/274

(58) Field of Search ..... 148/228, 229, 148/240, 242, 274; 252/390

(56) References Cited

U.S. PATENT DOCUMENTS

| | | | | |
|---|---|---|---|---|
| 3,303,063 A | | 2/1967 | Pietryka | 148/15.5 |
| 3,321,338 A | * | 5/1967 | Caubet et al. | 148/217 |
| 3,912,547 A | | 10/1975 | Gaucher et al. | 148/6.11 |
| 4,019,928 A | | 4/1977 | Beyer et al. | 148/15.5 |
| 4,184,899 A | * | 1/1980 | Blas et al. | 148/228 |
| 4,292,094 A | | 9/1981 | Kunst et al. | 148/217 |
| 4,492,604 A | | 1/1985 | Muller et al. | 148/228 |
| 4,717,429 A | | 1/1988 | Kunst et al. | 148/28 |
| 5,518,605 A | | 5/1996 | Hadj-Rabah et al. | 205/148 |

FOREIGN PATENT DOCUMENTS

| | | | |
|---|---|---|---|
| EP | 1055739 A2 | 5/2000 | C21D/9/50 |
| GB | 1105031 | 3/1965 | C23C/9/14 |

OTHER PUBLICATIONS

"Plasma Nitriding of Stainless Steels at Low Temperatures", B. Larisch et al, Technical University Freiberg, pp. 221–228.

"The Response of Austenitic Stainless Steels to Low-temperature Plasma Nitriding", Y. Sun et al, Heat Treatment of Metals, 1999, pp. 9–16.

"Influence of the Steel Composition and Treating Parameters on the Properties of Nitrocarburized Components", G. Wab 1989.

* cited by examiner

*Primary Examiner*—Andrew L. Oltmans
(74) *Attorney, Agent, or Firm*—William N. Hogg

(57) ABSTRACT

A composition for nitrocarburizing stainless steel parts and a method for producing a nitride or hard case on such parts using the composition, are provided. The composition includes alkali metal cyanate and alkali metal carbonate, wherein the cyanate ion is present in a weight percentage of greater than 45% and less than 55.2%. The composition is fused and maintained between about 750° F. and about 950° F. depending upon the type of stainless steel to be treated. The workpiece is immersed in the fused bath and left in until a satisfactory compound layer or case is formed. With austenitic stainless steel, the piece is immersed from about four hours to about six hours at temperatures between about 750° F. and about 950° F., preferably between 750° F. and 850° F. to maintain corrosion resistance.

With 400 series stainless steel, increased corrosion resistance is achieved by immersion for between four and six hours at 950° F.

2 Claims, 5 Drawing Sheets

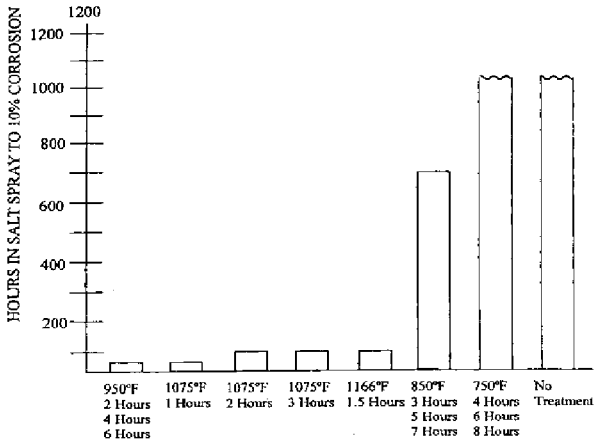

Fig 1

4/6 STAINLESS STEEL

DIFFUSION 416 STAINLESS STEEL

UNITED STATES PATENT AND TRADEMARK OFFICE

CERTIFICATE OF CORRECTION

PATENT NO. : 6,746,546 B2
DATED : June 8, 2004
INVENTOR(S) : Easterday et al.

It is certified that error appears in the above-identified patent and that said Letters Patent is hereby corrected as shown below:

Please replace the specification with the new attached specification including Figure 1.

Please replace Formal Drawings 1-5 with the attached drawings.

Column 7,
Line 13, after "the" (first occurrence), delete the numeral "5".

This certificate supercedes certificate of correction issued November 23, 2004,

Signed and Sealed this

Third Day of May, 2005

JON W. DUDAS
*Director of the United States Patent and Trademark Office*

(12) United States Patent
Easterday et al.

(10) Patent No.: US 6,746,546 B2
(45) Date of Patent: Jun. 8, 2004

(54) LOW TEMPERATURE NITRIDING SALT AND METHOD OF USE

(75) Inventors: James R. Easterday, Bloomfield Hills, MI (US); John F. Pilznienski, Dearborn Heights, MI (US)

(73) Assignee: Kolene Corporation, Detroit, MI (US)

( * ) Notice: Subject to any disclaimer, the term of this patent is extended or adjusted under 35 U.S.C. 154(b) by 135 days.

(21) Appl. No.: 10/002,282

(22) Filed: Nov. 2, 2001

(65) Prior Publication Data

US 2003/0084963 A1 May 8, 2003

(51) Int. Cl.[7] ..... C23C 8/26

(52) U.S. Cl. ..... 148/228; 148/229; 148/240; 148/242; 148/274

(58) Field of Search ..... 148/228, 229, 148/240, 242, 274; 252/390

(56) References Cited

U.S. PATENT DOCUMENTS

| | | | | |
|---|---|---|---|---|
| 3,303,063 A | | 2/1967 | Pietryka | 148/15.5 |
| 3,321,338 A | * | 5/1967 | Caubet et al. | 148/217 |
| 3,912,547 A | | 10/1975 | Gaucher et al. | 148/6.11 |
| 4,019,928 A | | 4/1977 | Beyer et al. | 148/15.5 |
| 4,184,899 A | * | 1/1980 | Blas et al. | 148/228 |
| 4,292,094 A | | 9/1981 | Kunst et al. | 148/217 |
| 4,492,604 A | | 1/1985 | Muller et al. | 148/228 |
| 4,717,429 A | | 1/1988 | Kunst et al. | 148/28 |
| 5,518,605 A | | 5/1996 | Hadj-Rabah et al. | 205/148 |

FOREIGN PATENT DOCUMENTS

| | | | |
|---|---|---|---|
| EP | 1055739 A2 | 5/2000 | C21D/9/50 |
| GB | 1105031 | 3/1965 | C23C/9/14 |

OTHER PUBLICATIONS

"Plasma Nitriding of Stainless Steels at Low Temperatures", B. Larisch et al, Technical University Freiberg, pp. 221–228.

"The Response of Austenitic Stainless Steels to Low-temperature Plasma Nitriding", Y. Sun et al, Heat Treatment of Metals, 1999, pp. 9–16.

"Influence of the Steel Composition and Treating Parameters on the Properties of Nitrocarburized Components", G. Wab 1989.

* cited by examiner

*Primary Examiner*—Andrew L. Oltmans
(74) *Attorney, Agent, or Firm*—William N. Hogg

(57) ABSTRACT

A composition for nitrocarburizing stainless steel parts and a method for producing a nitride or hard case on such parts using the composition, are provided. The composition includes alkali metal cyanate and alkali metal carbonate, wherein the cyanate ion is present in a weight percentage of greater than 45% and less than 55.2%. The composition is fused and maintained between about 750° F. and about 950° F. depending upon the type of stainless steel to be treated. The workpiece is immersed in the fused bath and left in until a satisfactory compound layer or case is formed. With austenitic stainless steel, the piece is immersed from about four hours to about six hours at temperatures between about 750° F. and about 950° F., preferably between 750° F. and 850° F. to maintain corrosion resistance.

With 400 series stainless steel, increased corrosion resistance is achieved by immersion for between four and six hours at 950° F.

2 Claims, 5 Drawing Sheets

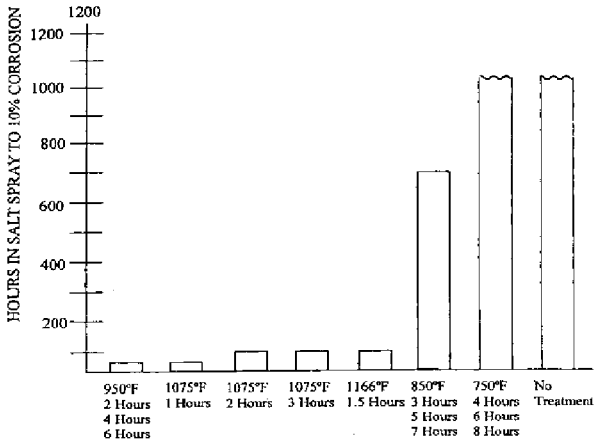

Fig 1

4/6 STAINLESS STEEL

DIFFUSION 416 STAINLESS STEEL